United States Patent [19]

Sanchez de Leon Rodriquez-Roda

[11] 4,084,697

[45] Apr. 18, 1978

[54] SIZER FOR FRUIT AND OTHER AGRICULTURAL PRODUCTS

[75] Inventor: D. Juan Antonio Sanchez de Leon Rodriquez-Roda, Valencia, Spain

[73] Assignee: Food Machinery Espanola, S.A., Valencia, Spain

[21] Appl. No.: 701,135

[22] Filed: Jun. 30, 1976

[30] Foreign Application Priority Data

Jun. 26, 1975 Spain ..... 213.486

[51] Int. Cl.[2] ..... B07B 13/04

[52] U.S. Cl. ..... 209/106

[58] Field of Search ..... 209/106, 102

[56] References Cited

U.S. PATENT DOCUMENTS

| | | | |
|---|---|---|---|
| 1,429,764 | 9/1922 | O'Quinn | 209/106 |
| 3,272,334 | 9/1966 | Russell | 209/106 |

*Primary Examiner*—Allen N. Knowles
*Attorney, Agent, or Firm*—Martin A. Farber

[57] ABSTRACT

A sizer for fruit and other agricultural products, comprising two paired cylinders in a calibrating unit forming a chain of pairs of rollers connected together by a support, the head of which, coincides with the axle of the upper roller, and in turn is connected to a drive chain which moves over a longitudinal guide from which one of the rollers is suspended. The other roller slides, in contacting support, on a flexible track which maintains a suitable support, avoiding impacts and noise. The flexing thereof provide different inclinations and thereby different sizings as a function of a larger or smaller amount of turning or screwing-in of spindles which control the height of the flexible track via supports for the track.

1 Claim, 4 Drawing Figures

SIZER FOR FRUIT AND OTHER AGRICULTURAL PRODUCTS

The present invention relates to a sizer, in general, and to a sizer for any type of fruit, and even for any other type of agricultural product, the selection being effected therein progressively and in succession, with complete elimination of noise and vibration, in particular.

Other sizer systems are known which are quite frequently used in the selection of fruit. Practically all of these systems have serious, substantial drawbacks, among which there may be mentioned the lack of variation of the sizing rollers, as well as the fact that the passage of the rollers between the calipers produces a substantial amount of noise, as well as the drawback that this beating or pounding changes the initial positions of calibration resulting in differences in selection during the course of operation.

Accordingly, it is an object of the present invention to provide a sizing device which overcomes these drawbacks, and which device is completely noiseless, and its initial values are permanent.

Such a sizing device constituting the object of the present invention has been created, and after many tests and studies it has proven its effectiveness for use in machines intended for the sizing of fruits and other agricultural products.

This sizer in accordance with the present invention which is applicable to machines specializing in this purpose, has numerous advantages in use, since it has a great production capacity and output, as well as providing a substantial improvement in the work which it performs.

With the above and other objects in view the present invention will become more clearly understood from the following detailed description of a preferred embodiment, in connection with the accompanying drawings, of which:

Figure 1:
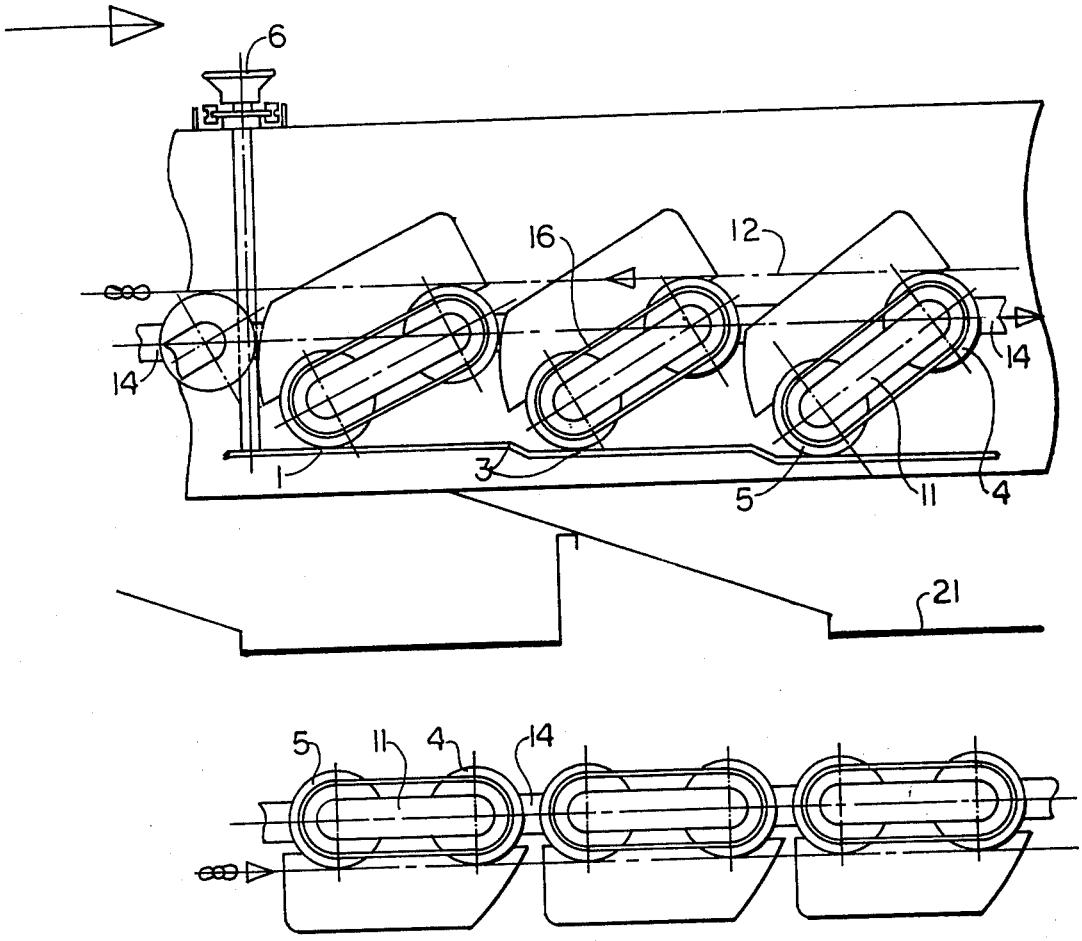
FIG. 1 is a side view of a portion of the sizing chain, going and coming, of the sizer in accordance with the present invention.
Figure 2:
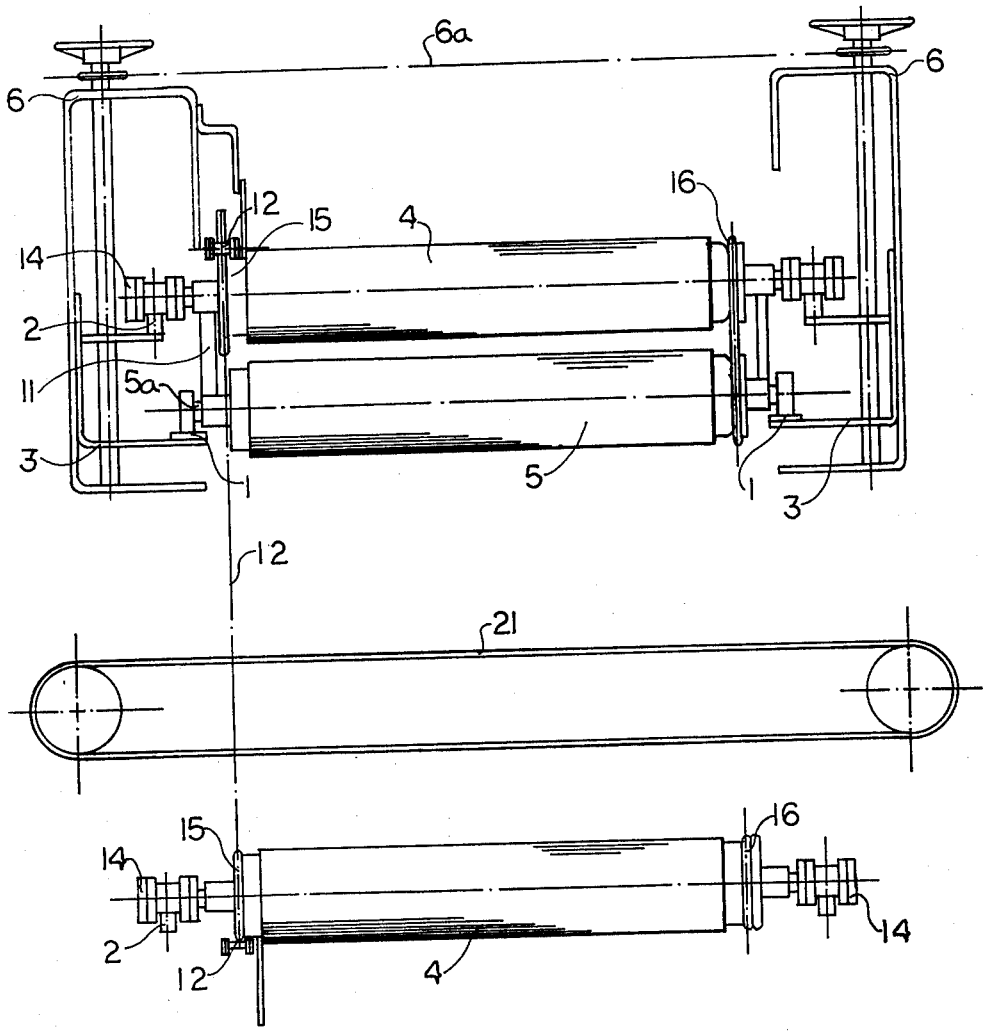
FIG. 2 is a front view corresponding to FIG. 1.
Figure 3:
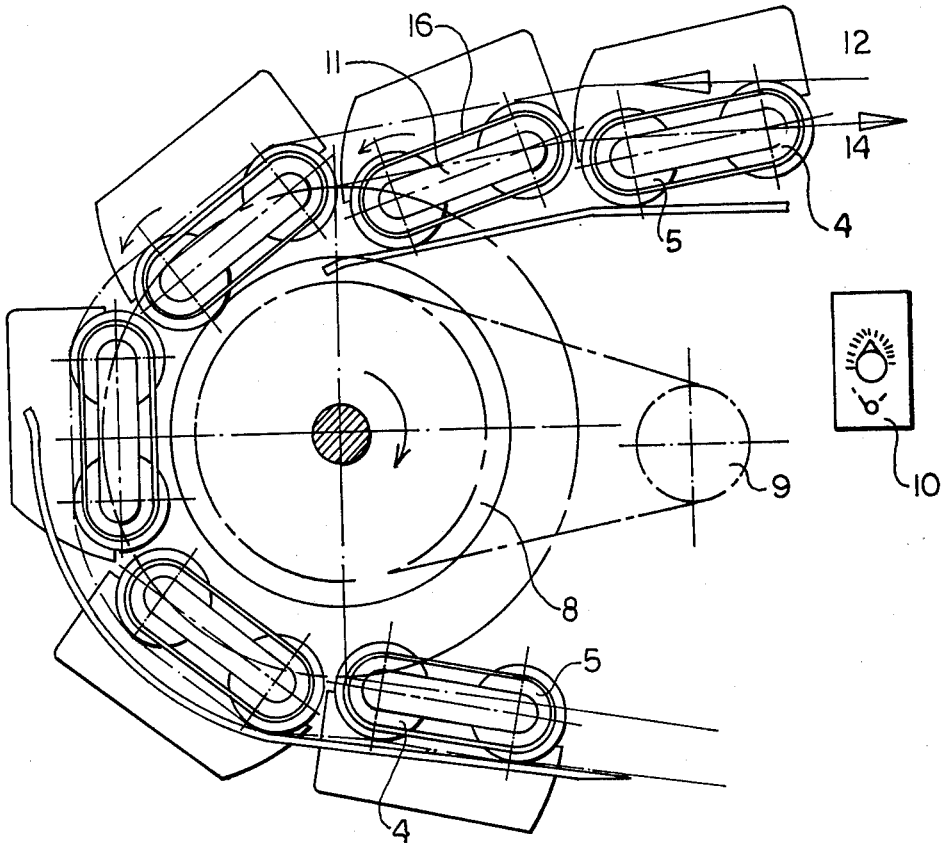
FIG. 3 is a side view of the head of the endless sizing chain with the motor which drives the rollers.
Figure 4:
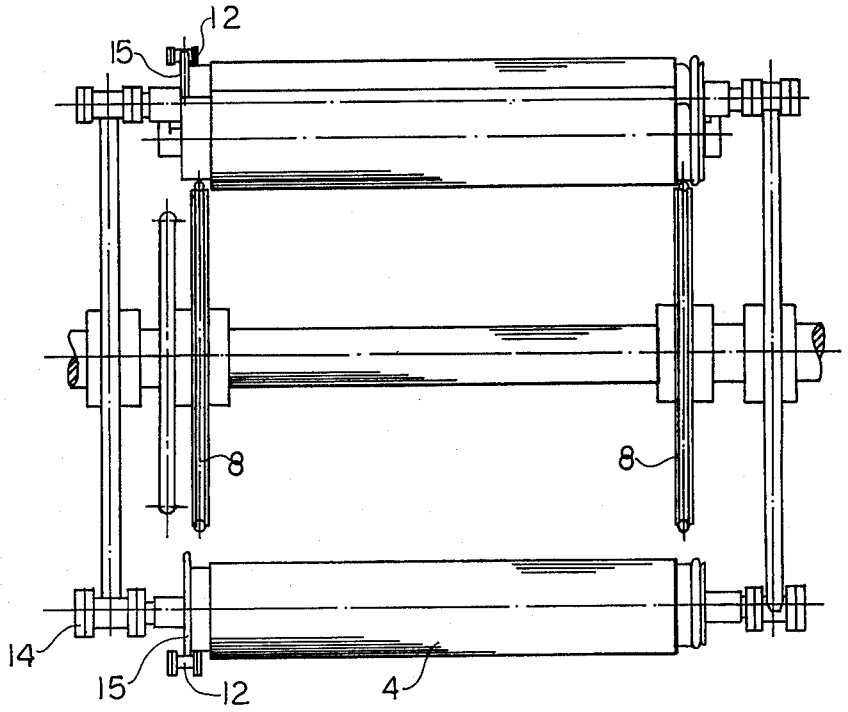
FIG. 4 is a front view of FIG. 3 with portions of the chain not being shown for clarity.

Referring now to FIGS. 1–4 of the drawings, a sizer device in accordance with the present invention comprises a flexible track or belt 1, which supported by a plurality of support sections or sectors or brackets 3, constitutes a rolling track for feeler rollers 5 (particularly for the feelers or rollers 5*a* mounted on the axle ends of the rollers 5) of the pair of rollers 4 and 5 which constitute each sizing unit, and which form mobile or moveable gates between the rollers 4 and 5. The rollers 4 and 5 are connected by a support 11. The roller 4 of each pair of rollers 4, 5 is fastened by its shaft to a main drive chain 14, which main drive chain 14 is moveably suppported on a longitudinal guide 2. The two rollers 4 and 5 of each pair are operatively connected together in movement by means of an endless belt 16, in such a manner that the movement of the feeler 5*a* is transmitted silently and gently to the pulled or dragging roller 4.

The variation of the sizing for fruits or other products is achieved by means of different heights at which the flexible track 1 is held by the supports 3, in such a manner that the passage of the feelers 5*a* of the rollers 5, depending on the higher or lower height of the track 1, produces a greater or smaller relative inclination upon the support 11, and thereby a greater or smaller separation between the tails or lines defined by each sizing unit (4,5,11), and it does so silently and without abnormal jerks.

This sizing is regulated and controlled from a plurality of forms on the basis of an actuation over spindles 6, which are connected on both sides of the sizer by means of a chain 6*a*, and which compels the supports 3 to assume different heights because of the sectors thereof, whereby the inclinations of the respective sizing units will depend on the highness or lowness of the sector support 3 as it contacts the feelers 5*a* of the roller 5.

The spindles 6 are formed as threaded helical screw-in spindles operatively mounted in particular on the individual sector supports 3, the latter being displaceable vertically along the connected spindle upon turning of the spindle. The chain 6*a* insures joint coordinated movement of the corresponding support sectors 3 to the same height on both sides of the sizing chain.

Two paired rollers or cylinders 4, 5 constitute each calibrating unit and all together connected by the main drive chain 14 form a sizing chain of pairs of rollers 4, 5. Each of the rollers 4 and 5 of each pair are connected together at both ends by a support 11, the head of which coincides with the axle of the upper roller 4, which in turn is connected to the main drive chain 14 which is moved by any conventional drive means over the longitudinal guide 2 from which one of the rollers 4 is suspended. The other roller 5 slides in contacting support on a flexible track 1, the latter being maintained by the supports 3 as a suitable support for the feelers 5*a*, avoiding impact and noise. The flexing of the track 1 to substantially follow the various heights of its support sectors 3 and provides different inclinations and thereby different sizings as a function of a larger or smaller amount of turning or screwing-in of the respective spindles 6 which control the height of the flexible track 1 via its supports 3.

Crosswise disposed conveyor belts 21 are provided under the going or operative selection performing portion of the sizing chain which convey away the selective sized fruit passing downwardly depending on the respective inclinations of the calibrating units in turn dependent on the heights of the supports 3.

The speed of rotation of the rollers 4 and 5 will depend on the shape and type of the fruit or the like to be sized, and is controlled and regulated by a control box 10 which is operatively connected to, and which acts on a motor 9, which in turn by a belt drives a wheel or pulley arrangement 8. The wheel 8 in turn by friction operatively drives the rollers 4 and those rollers 5 which at the moment are in contact with the wheel 8. By means of an endless chain 12 operatively connected around all the rollers 4 (concentric or parallel to the chain 14) and operatively driving wheels 15 which are secured to the rollers 4, this movement is transmitted to the rest of the rollers 4, and the latter, via wheels 15 and via the endless belts 16, transmit the movement to the feelers 5 of each sizing unit.

The two rollers 4 and 5 of each sizing unit are covered with elastic material, such as neoprene, in order to facilitate the turning or rolling of the driven fruit, which together with the fact that they are mounted on bearings and effect the sizing of the fruit between the rollers 4 and 5 of alternate condition or position, is extremely effective and silent.

While I have disclosed one embodiment of the present invention, it is to be understood that this embodiment is given by example only and not in a limiting sense.

I claim:

1. A sizer for fruit and other agricultural products, comprising a plurality of spaced apart calibrating units forming a sizing chain, each of said units comprising a pair of cylinders constituting an upper roller and a lower roller and a support connecting said rollers, said support having a head coinciding with the axis of said upper roller, a guide, drive chain means moveably disposed on said guide and connected to said upper rollers for driving said sizing chain, said upper rollers being operatively suspended from said guide and said drive chain means, a flexible track constituting a supporting surface for said lower rollers, the latter moveably disposed in contacting support on said flexible track, support means for supporting and controlling the height of said flexible track, said support means including screw-in spindle means for vertically displacing said support means, whereby the different heights of the latter determine different inclination orientations of said calibration units and different sizings of the fruit, an endless belt operatively disposed about said upper roller and said lower roller of each of said calibrating units, thereby joining said pair of cylinders in joint turning movement, the speed of rotation of said rollers being dependent of the fruit to be sized, a pulley wheel disposed in a portion of the path of movement of said rollers, motor means for turning said pulley wheel, the latter frictionally turning said rollers in said path in momentary tangential contact therewith, the speed of rotation of the rollers thereby further being dependent on the motor means, chain means disposed simultaneously about all of at least one of said rollers of each of said calibrating units for transmitting turning movement to all of said at least one of said rollers, said endless belts transmitting the turning movement to the remaining of said rollers.

* * * * *